US005848621A

United States Patent [19]

Cheung

[11] Patent Number: 5,848,621

[45] Date of Patent: Dec. 15, 1998

[54] CUTTER FOR STEEL STRAPPING TOOL

[75] Inventor: Nelson Cheung, Hoffman Estates, Ill.

[73] Assignee: Illinois Tool Works Inc., Glenview, Ill.

[21] Appl. No.: 620,241

[22] Filed: Mar. 22, 1996

[51] Int. Cl.[6] ..... B21F 11/00

[52] U.S. Cl. ..... 140/152; 30/351; 83/695; 83/955

[58] Field of Search ..... 225/91, 92, 96; 140/152, 93.2, 93.4, 93.6; 30/167, 168, 346, 351, 355, 356, 357; 83/697, 698.71, 699.11, 955, 678, 695

[56] References Cited

U.S. PATENT DOCUMENTS

| | | | |
|---|---|---|---|
| 1,529,683 | 3/1925 | Anderson | 30/168 X |
| 2,306,598 | 12/1942 | Ellson | 30/168 X |
| 3,231,972 | 2/1966 | Annese et al. | 30/168 |
| 4,079,646 | 3/1978 | Morishita | 83/955 X |
| 4,257,163 | 3/1981 | Bauer | 30/180 |
| 4,646,601 | 3/1987 | Borzym | 83/385 |
| 4,825,738 | 5/1989 | Jones | 30/351 X |
| 4,928,738 | 5/1990 | Marelin et al. | 140/93.4 |
| 4,949,615 | 8/1990 | Jordan | 83/674 |
| 4,962,686 | 10/1990 | Boyd et al. | 83/678 |
| 4,972,747 | 11/1990 | Boyd et al. | 83/678 |
| 5,103,702 | 4/1992 | Yannazzone | 83/697 X |
| 5,140,882 | 8/1992 | Hyder | 83/620 |
| 5,203,237 | 4/1993 | Cross | 30/351 X |
| 5,203,541 | 4/1993 | Nix | 254/218 |
| 5,237,899 | 8/1993 | Schartinger | 30/357 X |
| 5,322,091 | 6/1994 | Marelin | 140/152 X |
| 5,414,931 | 5/1995 | Wollermann | 30/90.1 |
| 5,428,959 | 7/1995 | Figiel et al. | 60/412 |
| 5,479,710 | 1/1996 | Aston | 30/357 X |
| 5,487,915 | 1/1996 | Russ et al. | 30/351 X |
| 5,499,664 | 3/1996 | Figiel et al. | 140/152 |
| 5,537,905 | 7/1996 | Zimmer et al. | 83/697 X |

FOREIGN PATENT DOCUMENTS

| | | | |
|---|---|---|---|
| 377400 | 6/1923 | Germany | 140/152 |
| 328983 | 5/1930 | United Kingdom | 140/152 |

OTHER PUBLICATIONS

Signode SPC–12/58/34 Pneumatic Combination Strapping Tool, 1995.

Signode SMC–12/58/34 Combination Strapping Tool, 1992.

Signode SLC –38/12/58/34 Manual Combination Strapping Tool for General Duty Strap Only, 1993.

*Primary Examiner*—Clark F. Dexter

*Attorney, Agent, or Firm*—Schwartz & Weinrieb

[57] ABSTRACT

A cutter implement, for use within a cutting tool in connection with the securing of a tensioned steel strap about a package wherein a pair of vertically overlapped end portions of the tensioned steel strap are supported upon an anvil, is provided with a non-cutting recessed portion or notched region at a substantially central portion of its cutting edge such that if the cutting assembly of the cutting tool experiences overtravel movements with respect to the anvil and the pair of vertically overlapped end portions of the tensioned steel strap supported thereon, while the upper one of the pair of vertically overlapped end portions of the tensioned steel strap will be severed by the cutter implement, and while the upper surface of the lower one of the pair of vertically overlapped end portions of the tensioned steel strap may be scored by the cutting edge of the cutter implement, that portion of the lower one of the pair of vertically overlapped end portions of the tensioned steel strap which is engaged by or disposed opposite the non-cutting recessed portion or notched region of the cutter implement will remain structurally intact so that the lower one of the vertically overlapped end portions of the tensioned steel strap does not undergo rupture, breakage, or fracture in view of the inherent brittleness of the strap and the tensile stresses incorporated therein.

22 Claims, 2 Drawing Sheets

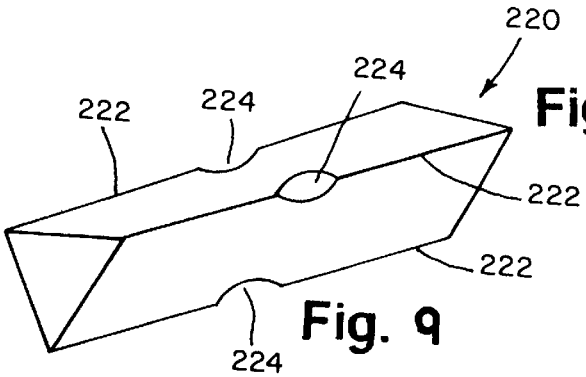
Fig. 9
Fig. 3
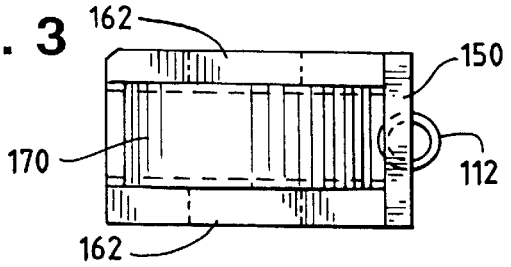
Fig. 4
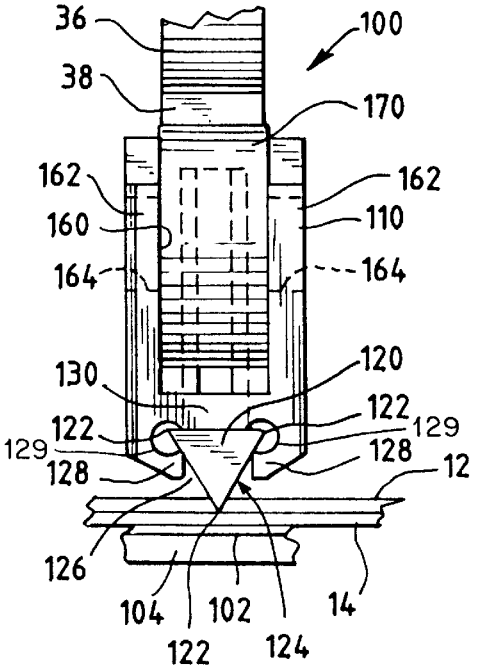
Fig. 5
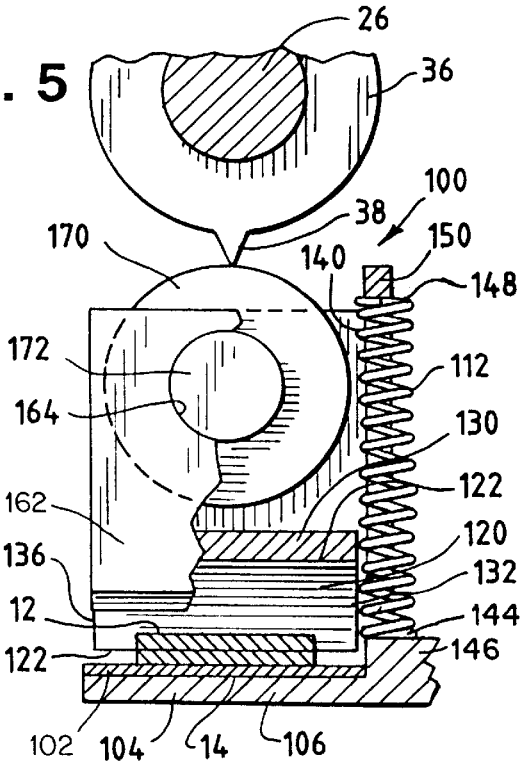
Fig. 7
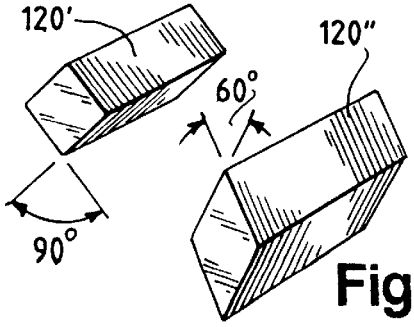
Fig. 8
Fig. 6
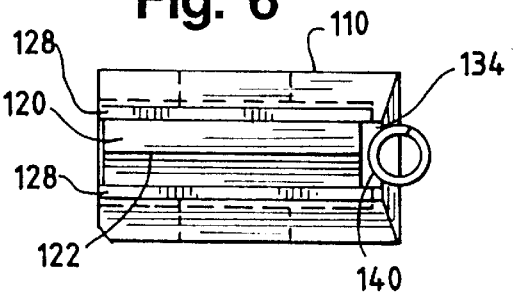

CUTTER FOR STEEL STRAPPING TOOL

FIELD OF THE INVENTION

The present invention relates generally to a steel strapping tool, having a removable cutter implement incorporated therein, of the type used to apply a steel strap in a tensioned loop around a package by means of a series of interlocking joints comprising interlockable shoulders punched into two overlapped ends of the strap, and more particularly to an improved cutter implement which prevents the complete severance of the lower one of the two overlapped ends of the tensioned strap, in the event that the tool holder, within which the cutter implement is removably mounted, experiences overtravel with respect to an anvil which supports the overlapped ends of the strap during a cutting operation, whereby the structural integrity of the tensioned strap disposed around the package will be preserved and will not be compromised by an inadvertent cutting of the lower one of the two overlapped ends of the tensioned strap so as not to result in structural failure of the strap once the strap has been disposed around the package in its tensioned state.

BACKGROUND OF THE INVENTION

Strapping tools of the aforenoted type are exemplified by means of U.S. Pat. No. 5,203,541 issued to Robert J. Nix, and U.S. Pat. No. 3,998,429 issued to Nelson Cheung, both of such patents having been assigned to SIGNODE CORPORATION, the assignee of record of the present patent application. U.S. Pat. No. 4,825,512 is also exemplary of a steel strap having a series of interlocking joints formed by means of interlockable shoulders punched into the overlapped ends of the steel strap.

In general, a strapping tool of the aforenoted type comprises an actuating handle which is adapted to be manually oscillated. The actuating handle rotates an input shaft which actuates an output shaft through means of a plurality of intermediate bevel gears. A plurality of cams are mounted upon the output shaft, and the cams are operatively connected to a plurality of punches which are driven thereby so as to punch the interlockable shoulder segments into the two overlapped ends of the steel strap. One of the cams also drives the cutter assembly, within which the cutter implement is removably mounted, such that the cutter implement normally or desirably compressively cuts through only the upper one of the two overlapped ends of the tensioned strap disposed around the package, without cutting the lower one of the two overlapped ends of the tensioned strap, so as to sever the tensioned strap, disposed around the package, from residual steel strapping disposed upon a supply reel. An anvil supports the overlapped ends of the tensioned strap as the cutter implement compressively cuts through the upper one of the two overlapped ends of the tensioned strap. Manually or similarly operated strapping tools of the aforenoted type are commercially available from SIGNODE CORPORATION, a subsidiary of ILLINOIS TOOL WORKS INC. More particularly, examples of such commercially available tools are SIGNODE Model SMC-12/58/34 Combination Strapping Tool, SIGNODE Model SLC-38/12/58/34 Manual Combination Strapping Tool, and SIGNODE Model SPC-12/58/34 Pneumatic Combination Strapping Tool.

While the aforenoted strapping tools have been very successful commercially, and wherein such tools normally do not exhibit or experience any operational problems during performance of the strap tensioning and severing operations, overtravel or overshoot movements of the cutter assembly have occasionally occurred which have, in effect, led to the disposition of defective tensioned straps around packages being processed. More particularly, such overtravel or overshoot movement of the cutter assembly may occur within the strapping tool for any one of a variety of reasons, such as, for example, the tolerances inherently comprising the range of movement of the cutter assembly within the strapping tool, or similar tolerances inherently incorporated within the various structural components or their relative disposition or arrangement within the cutter assembly, or still further, due to the immediate adjacent disposition of the two overlapped ends of the tensioned strap with respect to each other. In any case, should the cutter assembly experience or exhibit overshoot or overt-ravel movement with respect to the support anvil, not only will the upper one of the overlapped ends of the tensioned strap be severed as desired, but in addition, the lower one of the overlapped ends of the tensioned strap will likewise be severed, or partially severed as considered in the depth direction or thickness of the steel strap, or at least scored. Due to the fact that the steel strap is somewhat brittle and is also being subjected to a significant amount of tensile stress, such partial severance or scoring of the steel strap can eventually lead to structural failure or rupture of the steel strap which would, in turn, result in potentially hazardous conditions to operator personnel as well as improper fixation or securement of the packaged loads.

A need therefore exists for a cutter implement which may be removably mounted within the cutter assembly of a strapping tool of the aforenoted type wherein the cutter implement will, in effect, compensate for or accommodate overtravel or overshoot movements of the cutter assembly whereby only the upper one of the overlapped ends of the tensioned strap will be completely severed so as to in fact achieve separation of the tensioned steel strap from the residual steel strapping disposed upon the supply reel while the lower one of the overlapped ends of the tensioned strap will only be partially scored across the lateral or widthwise extent thereof such that a predetermined portion of such lower strap, across the lateral or widthwise extent thereof, will not be at all severed or scored so as to in fact desirably preserve the structural integrity of the overall tensioned strap disposed around the package and thereby effectively prevent the occurrence of the aforenoted potentially hazardous conditions.

OBJECTS OF THE INVENTION

Accordingly, it is an object of the present invention to provide a new and improved cutter implement for use within a steel strapping tool.

Another object of the present invention is to provide a new and improved cutter implement for use within a steel strapping tool so as to effectively prevent the severance of the lower one of the two overlapped ends of a tensioned strap disposed around a package, even when the cutter assembly, within which the cutter implement is removably mounted, may experience, exhibit, or undergo overtravel or overshoot movements with respect to the supporting anvil of the strapping tool upon which the two overlapped ends of the tensioned strap are supported during the cutting operation, whereby the aforenoted potentially hazardous conditions can be effectively prevented from occurring.

SUMMARY OF THE INVENTION

The foregoing and other objectives of the present invention are achieved through the provision of a new and improved cutter implement, and a strapping tool within which the cutter implement is removably mounted, which is capable of completely compressively cutting or severing the upper one of the two overlapped ends of a tensioned strap disposed around a package, while effectively preventing the complete compressive cutting, severing, or scoring of the lower one of the two overlapped ends of the tensioned strap disposed around the package, while the two overlapped ends of the tensioned strap are supported upon an anvil which is disposed beneath a vertically reciprocable cutter assembly of the strapping tool within which the cutter implement is removably mounted. The cutter implement is an elongate member and the implement is mounted within the cutter assembly such that its longitudinal extent or axis is disposed transversely across the lateral or widthwise extents of the two overlapped ends of the tensioned strap as the two overlapped ends of the tensioned strap are supported upon the anvil.

The cutter implement preferably has a polygonal cross-sectional configuration and comprises a plurality of elongate or longitudinal cutting edges. The cutter implement is mounted within a cutter holder of the cutter assembly in such a manner that one of the plurality of cutting edges is disposed toward the anvil while the other cutting edges are disposed internally within the cutter holder so as not to be prematurely dulled prior to actual use thereof. When the cutting edge currently being used becomes dull as a result of a predetermined amount of usage during strap cutting operations, the cutter implement is removed from the cutter holder, the implement is rotated about its longitudinal axis such that a new or fresh unused cutting edge is now disposed toward the anvil, and the implement is replaced within the cutter holder. The strapping tool is then ready to perform additional cutting operations.

In accordance with the particular improvements incorporated within or comprising the cutter implement of the present invention, each one of the plurality of cutting edges of the cutter implement has defined therein, or is provided with, a non-cutting notched or recessed portion which recedes or extends away from the respective cutting edge of the cutter implement. The non-cutting recessed or notched portion has a predetermined longitudinal length which effectively corresponds to approximately 10–20% of the lateral or widthwise extent of each one of the two overlapped ends of the tensioned strap, and the depth of the notched or recessed portion essentially corresponds to the thickness of the tensioned strap. Consequently, during normal reciprocable movements of the cutter assembly, that is, when the cutter assembly does not experience or undergo any overtravel or overshoot movements, the upper one of the two overlapped ends of the tensioned strap will be completely severed or cut across its widthwise extent, by means of the particular cutting edge of the cutter implement which is disposed toward the supporting anvil, except for the region of the upper one of the two overlapped ends of the tensioned strap which is encountered by means of the non-cutting notched or recessed portion of the cutting edge of the cutter implement. Nevertheless, in view of the fact that the strap is brittle and is also under a significant amount of tensile stress, such partially severed strap, as considered in the transverse or widthwise direction, will rupture and be separated from the residual supply of strapping disposed, for example, upon a supply reel. The lower one of the two overlapped ends of the tensioned strap is of course not at all severed or scored during such normal cutting operations of the cutter implement and cutter assembly.

Conversely, however, during those reciprocable movements of the cutter assembly wherein the assembly does experience or undergo overtravel or overshoot movements, the cutting edge of the cutter implement, after completely penetrating and severing the upper one of the two overlapped ends of the tensioned strap, will partially penetrate and score the uppermost surface portion of the lower one of the two overlapped ends of the tensioned strap but that part of the lower one of the two overlapped ends of the tensioned strap which is encountered by means of the non-cutting recessed or notched portion of the cutter implement will not be severed or scored. Thus, in view of the fact that no portion of the lower one of the two overlapped ends of the tensioned strap is actually severed or cut, but in the worst case scenario is only partially scored, the structural integrity of the lower one of the two overlapped ends of the tensioned strap is thereby preserved, such lower one of the two overlapped ends of the tensioned strap does not experience undesirable rupture, and the package is properly secured without having any potentially hazardous conditions incorporated therein.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 3 is a top plan view, on a further enlarged scale, of the cutter assembly of FIG. 2 showing the cutter holder, the roller, and the biasing spring thereof;

FIG. 4 is a front elevation view of the cutter assembly of FIG. 2, showing the cutter holder, the cutter implement, and the roller thereof, wherein a cam is shown coacting with the roller of the cutter assembly such that the cutter implement is forced into engagement with the upper one of the two overlapped ends of a tensioned strap disposed upon a supporting anvil;

FIG. 5 is a partly fragmentary, side elevation view of the cutter assembly of FIG. 4 showing the cutter holder, the cutter implement, the roller, the biasing spring, the cam, the anvil, and the overlapped ends of the tensioned strap supported upon the anvil;

FIG. 6 is a bottom plan view, similar to that of FIG. 3, showing the cutter assembly of FIG. 2 which includes the cutter holder, the cutter implement, and the biasing spring;

FIGS. 7 and 8 are perspective views of two cutter implements which have cross-sectional configurations which are different from that of the cutter implement shown in FIGS. 2 and 4; and FIG. 9 is a perspective view, on an enlarged scale, of the new and improved cutter implement constructed in accordance with the teachings of the present invention and which is particularly adapted for use within the cutting assembly of the strapping tool shown in FIG. 1.

DETAILED DESCRIPTION OF THE ILLUSTRATED EMBODIMENTS

Figure 1:
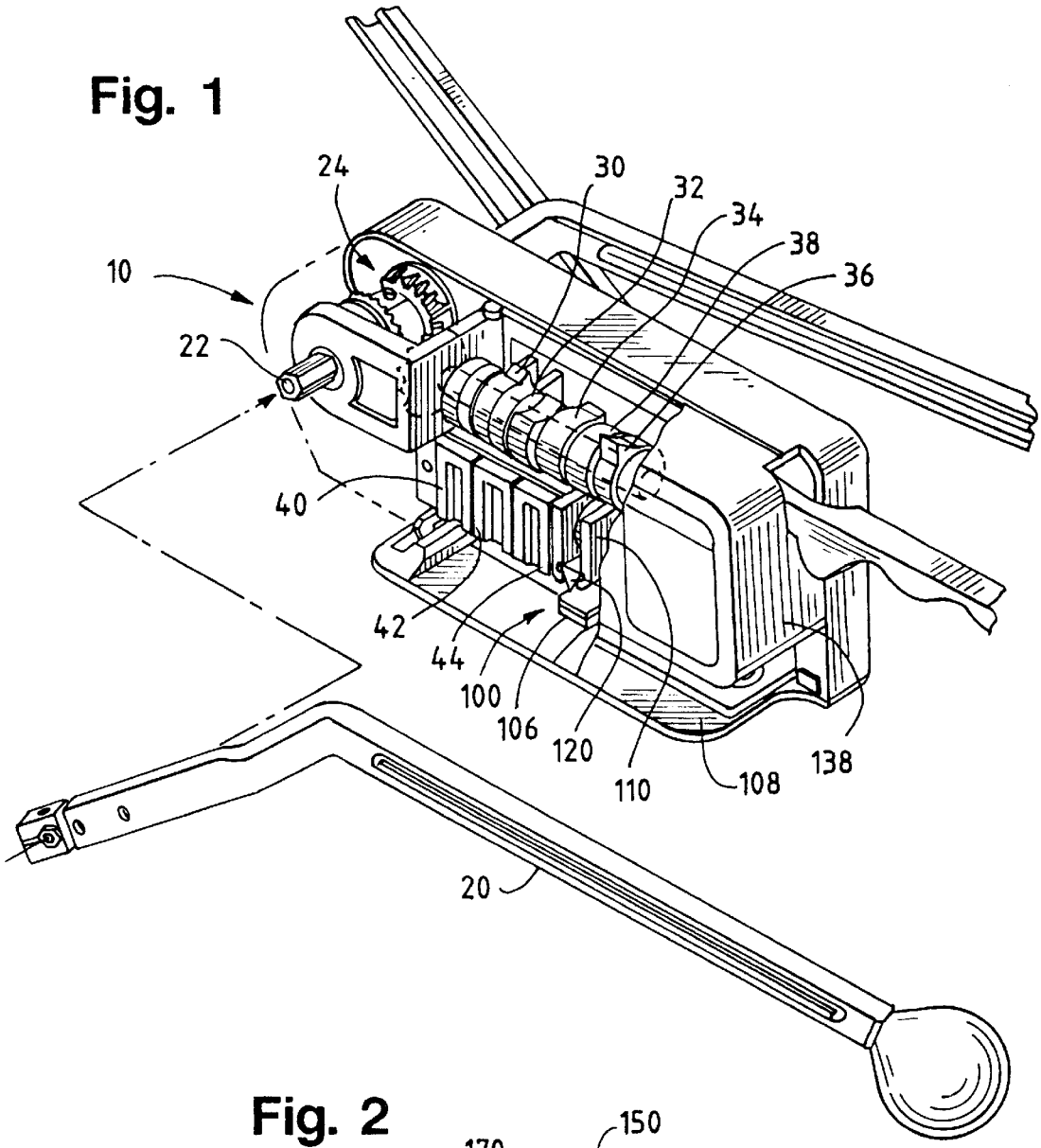
FIG. 1 is a fragmentary, partly exploded, perspective view of a strapping tool of the type noted hereinabove and within which the improved cutter of the present invention may be employed.

Referring now to the drawings, and more particularly to FIG. 1 thereof, a strapping tool of the type noted hereinabove, and within which the new and improved cutter implement of the present invention can be removably incorporated, will be described first, and subsequently, the details, features, and attendant advantages of the new and improved cutter implement of the present invention will be described second. As shown in FIG. 1, a strapping tool is generally indicated by the reference character 10, and while the tool 10 is illustrated as being of the type as more particularly set forth and disclosed within the company manual describing the SIGNODE Model SMC-12/58/34 Combination Strapping Tool, the tool 10 can similarly be or comprise SIGNODE Model SLC-38/12/58/34 Manual Combination Strapping Tool or SIGNODE Model SPC-12/58/34 Pneumatic Combination Strapping Tool. The strapping tool 10 is used to apply a steel strap in a tensioned loop around a package, and the strap is secured upon the package by means of a series of interlocking joints comprising interlockable shoulders punched into two overlapped ends of the tensioned strap.

The strapping tool 10 incorporates therein a cutting assembly 100, and as shown in FIGS. 4 and 5, in which the overlapped ends of the tensioned steel strap disposed around a package, not shown, are shown fragmentally, the cutting assembly 100 is used for compressively cutting through the upper end 12 of the looped steel strap being applied to the package, so as to sever the applied strap from a supply of strapping, not shown, without cutting the lower end 14 of the steel strap being applied to the package. Except for the cutting assembly 100, and the new and improved cutter implement comprising the present invention, the strapping tool 10 is similar to the strapping tools disclosed within U.S. patent application Ser. No. 08/133,284, now U.S. Pat. No. 5,353,659, and U.S. patent application Ser. No. 08/133,290, now U.S. Pat. No. 5,392,821, the disclosures of which are hereby incorporated herein by reference.

Referring again to FIG. 1, the strapping tool 10 is seen to comprise an actuating handle 20 which is operatively connected to an input shaft 22 so as to impart oscillatory movement to the input shaft 22 as the handle 20 is manually oscillated. The oscillatory movement of the input shaft 22 is, in turn, converted to rotational movement of an output shaft 26 by means of a set of intermediate bevel gears 24, and four cams 30, 32, 34, and 36 are coupled to the output shaft 26 so as to rotatably oscillate conjointly therewith. The cams 30, 32, and 34 drive three punches 40, 42, and 44 which punch the aforenoted interlockable shoulder portions into the overlapped ends 12 and 14 of the steel strap being applied to the package, and dies, not shown, underlie the overlapped ends 12 and 14 of the steel strap so as to cooperate with the punches 40, 42, and 44 in forming the interlockable shoulder portions within the overlapped ends 12 and 14 of the steel strap when the strap is applied to the package. As will be discussed further, the cam 36, which has a single lobe 38, is provided for actuating the cutter assembly 100 and more particularly the cutter holder 110 thereof.

As best seen in FIGS. 4 and 5, the cutting assembly 100 comprises an anvil 102 which is fixedly mounted upon a lower step portion 104 of a stepped platform 106 which, in turn, is fixed to or integrally formed upon a base plate 108 of the strapping tool 10. The anvil 102 supports the overlapped ends 12 and 14 of the steel strap as the upper end 12 of the strap is compressively cut by the cutter implement 120 mounted within the cutter assembly 100. More particularly, the cutting assembly 100 comprises a cutter holder 110 which is mounted within the strapping tool 10 so as to be vertically movable within a limited or defined range of vertical movement, and the cutter implement 120 is removably mounted within the cutter holder 110. The cutter holder 110 and the elongate cutter implement 120 are movable toward and away from the anvil 102 between cutting and non-cutting positions, and the cutting assembly 100 further comprises a biasing spring 112 which comprises a coiled wire which is adapted to bias the cutter holder 110 and the cutter implement 120 thereof away from the anvil 102 and toward the non-cutting position.

As shown in FIGS. 2, 4, 5, and 6, the elongate cutter implement 120 is machined from tool steel so as to have an equilateral triangular cross-sectional configuration and therefore comprises three parallel cutting edges 122 and three planar surfaces which define acute angles of sixty degrees therebetween as determined by the intersection of the three planar surfaces. The cutter holder 110 is machined so as to have an elongate recess 124 defined within a lower end portion thereof wherein a lower open end 126 thereof opens downwardly from recess 124 so as to face towards the anvil 102. More particularly, the recess 124 is defined by means of a pair of oppositely disposed sidewalls 128 and an upper wall 130 wherein the sidewalls 128 and upper wall 130 respectively engage the planar surfaces of the cutter implement 120. The elongate cutter implement 120 is configured so as to be disposed lengthwise within the elongate recess 124 of the cutter holder 110 such that one of the cutting edges 122 protrudes downwardly through the elongate open end 126 of the recess 124, between the opposed sidewalls 128, when the cutter implement 120 is mounted within the cutter holder 110, while the other two cutting edges 122, which are not disposed at the cutting position, are disposed within recessed portions 129 of the cutter holder 110 such that these inoperative cutting edges 122 are not prematurely marred, scratched, nicked, or otherwise dulled prior to their intended cutting use. The opposed sidewalls 128 thus engage the two laterally separated planar surfaces of the elongate cutter implement 120 such that the implement 120 cannot drop downwardly through the elongate open end or slot 126 of the cutter holder 110, and the sidewalls 128 further cooperate with the upper wall 130 of the cutter holder 110 so as to prevent the cutter implement from rotating within the cutter holder 110 once the cutter implement 120 is mounted within the cutter holder 110. It is further noted that a rear end 132 of the cutter implement 120 is adapted to be engaged by means of a rear stop 134, while a forward end 136 of the cutter implement 120 is retained by means of a front cover 138 of the strapping tool 10. The cover 138 is removable from the tool 10 so as to provide access to the cutter holder 110 and the elongate cutter implement 120.

As shown in FIGS. 5 and 6, the cutter holder 110 is also machined so as to define within a rear portion thereof a vertically oriented, semi-cylindrical recess 140 which opens rearwardly and within which is disposed the biasing spring 112. A lower end 144 of the biasing spring 112 bears against an upper step 146 of the stepped platform 106, and an upper end 148 of the biasing spring 112 bears against a cross member 150 of the cutter holder 110. The biasing spring 112 is compressed so as to bias the cutter holder 110, and the elongate cutter implement 120 mounted therein, upwardly away from the anvil 102. The cutter holder 110 is further machined so as to also define a recess 160, between opposed side walls 162, within which a roller 170 is housed or accommodated. The side walls 162 are respectively provided with coaxially aligned circular apertures 164, and the roller 170 is provided with a shaft 172 whose ends are rotatably accommodated within the apertures 164 of the side walls 162 so as to rotatably mount the roller 170 within the cutter holder 110 in such a manner that the uppermost portion of the roller 170 is disposed above the upper ends of the side walls 162. The upward biasing of the cutter holder 110 by means of the biasing spring 112 thus biases the roller 170 upwardly so that the roller 170 bears against and is engaged with the cam 36 having the single lobe 38.

Thus, it may be appreciated that except for the operative period of time when the cam 36 is rotatably positioned such that the single lobe 38 thereof begins to engage the roller 170, the cam 36 will permit the cutter holder 110 and the cutter implement 120 mounted therein to move upwardly away from the anvil 102 under the influence of the biasing force of the biasing spring 112. When the cam 36 is rotated so that the single lobe 38 thereof begins to engage the roller 170, the single cam lobe 38 cams the roller 170 downwardly so as to, in turn, drive the cutter holder 110 and the elongate cutter implement 120 thereof downwardly toward the anvil 102 and against the upward biasing force of the biasing spring 112. As illustrated in FIGS. 4 and 5, when the cutter holder 110 and the cutter implement 120 are driven downwardly by means of the single cam lobe 38, the cutting edge 122, projecting downwardly toward the anvil 102 and through the open end or slot 126, compressively cuts the upper end 12 of the overlapped ends of the steel strap, without cutting the lower end 14 of the overlapped ends of the steel strap, as the overlapped ends 12 and 14 of the steel strap are supported upon the anvil 102. Once the single lobe 38 of the cam 36 has passed the roller 170 as a result of its angular or rotatable movement, the biasing spring 112 causes the cutter holder 110 and the cutter implement 120 thereof to move upwardly away from the anvil 102 as well as away from the severed end 12 of the steel strap.

It is to be noted at this juncture that as a result of the particular cross-sectional configuration of the cutter implement 120, when the particular one of the cutting edges 122, which projects downwardly through the open end or slot 126 of the cutter holder 110, becomes dull from prolonged or extended use during operation of the strapping tool 10, the front cover 138 is removed from the tool 10 so as to provide access to the cutter holder 110 and the cutter implement 120 mounted therein. The cutter implement 120 is then removed from the cutter holder 110, rotated about its longitudinal axis so that another one of the cutting edges 122 thereof is disposed at the proper angular position for projecting downwardly through the open end or slot 126 of the cutter holder 110, and then replaced within the cutter holder 110. Thus, there is no need to replace the cutter implement 120 until all three of the cutting edges 122 have become dull as a result of prolonged or extended use.

Figure 2:
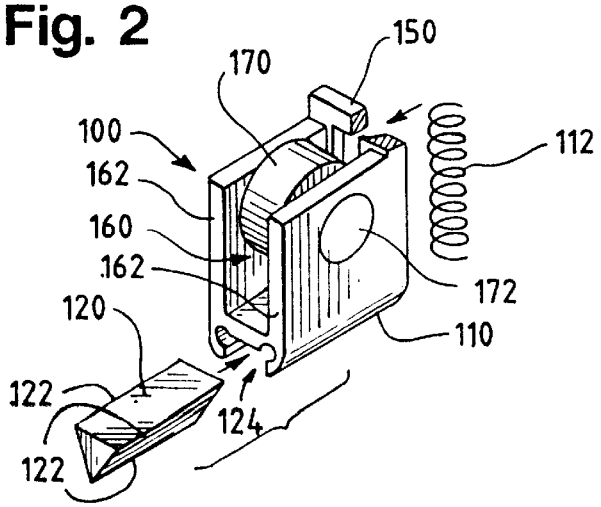
FIG. 2 is an exploded, perspective view, on an enlarged scale, of the strapping tool cutter assembly which comprises a cutter holder, an elongate cutter implement, similar to the improved cutter implement of the present invention, which may be removably mounted within the cutter holder, a roller, a shaft for the roller, and a biasing spring.

In accordance with the foregoing, it is seen from FIGS. 2 and 4 that the elongate cutter implement 120 is machined so as to have a cross-sectional configuration which is essentially that of an equilateral triangle whereby there are provided three cutting edges 122, and the planar surfaces of the cutter implement 120 define acute angles of sixty degrees therebetween. Other cutter implements, however, having different cross-sectional configurations, are of course possible. As shown in FIG. 7, for example, an elongate cutter implement 120' is machined from tool steel so as to have a square cross-sectional configuration wherein four cutting edges are provided, and the planar surfaces of the cutter implement 120' define angles of ninety degrees therebetween. It is to be noted, of course, that the cutter holder of the cutting assembly must be accordingly modified so as to be capable of properly housing or accommodating the cutter implement 120' therewithin. Continuing still further, a third embodiment of a cutter implement is illustrated in FIG. 8, is designated by the reference character 120", and is seen to have a cross-sectional configuration which is that of a rhombus. This implement therefore likewise comprises four cutting edges wherein a first set of opposite pairs of the planar surfaces of the cutter implement 120" define acute angles of sixty degrees therebetween, while a second set of opposite pairs of the planar surfaces of the cutter implement 120" define obtuse angles of one-hundred twenty degrees therebetween. As was true with respect to the cutter implement 120' of FIG. 7, the cutter holder of the strapping tool must of course be modified so as to be able to house or accommodate the cutter implement 120".

In accordance with the foregoing, and particularly in connection with the description of the operation of the cutting tool as described in connection with FIGS. 4 and 5 wherein the cutter implement 120 has been used to cut or sever the upper one 12 of the two overlapped ends 12 and 14 of the tensioned steel strap when such ends 12 and 14 of the steel strap are supported upon the anvil 102, it has been noted that only the upper one 12 of the two overlapped ends 12 and 14 of the tensioned steel strap is severed or cut by the cutter implement 120 whereas the lower one 14 of the two overlapped ends of the tensioned steel strap is not at all cut or severed. However, this cutting operation only occurs when the cutting assembly 100 is operating precisely and properly in accordance with predetermined tolerances inherent in the cutting tool 10. If the cutting tool 10 does not operate precisely in connection with such inherent tolerances, then the tool 10, and the cutting assembly 100 thereof, can experience overtravel or overshoot movements when, for example, the cam 36 angularly rotates such that the lobe 38 thereof biases the cutter holder 110, and the cutter implement 120 thereof, downwardly toward the anvil 102 whereby, for example, the particular, downwardly projecting cutting edge 122 of the cutter implement 120 not only cuts through and severs the upper one 12 of the overlapped ends 12 and 14 of the tensioned steel strap, but in addition, causes partial severance or scoring of the lower one 14 of the two overlapped ends 12 and 14 of the steel strap. In view of the brittle nature of the steel strap, and in view of the additional fact that the strap is under a significant amount of tensile stress, such scoring of the lower one 14 of the two overlapped ends 12 and 14 of the tensioned steel strap, across its entire widthwise extent, can cause rupture or failure of the lower one 14 of the two overlapped ends 12 and 14 of the tensioned steel strap whereby potentially hazardous conditions are presented, and the package being strapped is not properly secured.

In accordance with the teachings of the present invention, a new and improved cutter implement, generally indicated by the reference character 220, is therefore disclosed in FIG. 9 in order to rectify and eliminate the potential problems which may present themselves within a typical cutting tool such as that as disclosed within FIG. 1 of the drawings when the tool exhibits, experiences, or undergoes overtravel or overshoot movements. As can be appreciated from a comparison between FIGS. 2, 4, and 9, the cutter implement 220 of FIG. 9 is seen to be quite similar to the cutter implement 120 of FIGS. 2 and 4 in that the same comprises an elongate implement which has a substantially equilateral triangular cross-sectional configuration. Consequently, the cutter implement 220 is provided with three cutting edges 222 and can be removably mounted within the same cutter holder 110 of the cutting tool 10 as was the cutter implement 120. The only major difference between the cutter implement 220 of the present invention as disclosed within FIG. 9 and the cutter implement 120 as disclosed within FIGS. 2 and 4 resides in the provision of a non-cutting recessed portion or notched region 224 within the substantially central portion of each one of the cutting edges 222 of the implement 220. Each recessed portion or notched region 224 has a longitudinal or axial extent which comprises approximately 10–20% of the widthwise extent of the steel strap being tensioned about the particular package. The depth of the recessed portion or notched region 224 is also substantially equal to the thickness of the steel strap being tensioned about the package.

Consequently, when the cutter implement 220 is employed within the cutting assembly 100 of the tool 10, and the cutting assembly 100 of the tool 10 does not experience any overtravel or overshoot movements, the cutting operation will proceed basically in the same manner as depicted within FIGS. 4 and 5 in connection with the cutter implement 120. More particularly, the cutter implement 220 will penetrate the upper one 12 of the two overlapped ends 12 and 14 of the tensioned steel strap supported upon the anvil 102 as depicted in FIGS. 4 and 5 without at all penetrating the lower one 14 of the two overlapped ends 12 and 14 of the tensioned steel strap whereby the downwardly projecting cutting edge 222 of the cutter implement 220 will cut or sever the upper one 12 of the two overlapped ends 12 and 14 of the tensioned steel strap across the entire widthwise extent of the upper one 12 of the two overlapped ends 12 and 14 of the tensioned steel strap except for that portion of the upper one 12 of the two overlapped ends 12 and 14 of the tensioned steel strap which is engaged by the non-cutting recessed portion or notched region 224 of the downwardly projecting cutting edge 222. However, in view of the facts that the length of the portion of the upper one 12 of the two overlapped ends 12 and 14 of the tensioned steel strap which is engaged by the non-cutting recessed portion or notched region 224 of the cutting edge 222 of the cutter implement 220 comprises only 10–20% of the widthwise extent of the upper one 12 of the two overlapped ends 12 and 14 of the tensioned steel strap, that the remaining 80–90% of the upper one 12 of the two overlapped ends 12 and 14 of the tensioned steel strap, as considered in its widthwise direction, has been entirely severed or cut, and that the entire steel strap disposed or wrapped about the package is brittle and under a significant amount of tensile stress, the upper one 12 of the two overlapped ends 12 and 14 of the tensioned steel strap will in fact snap, rupture, or break thereby separating the tensioned steel strap wrapped around the package from the residual supply of steel strapping.

Considering next the operative instance in which the cutting tool 10 and cutter assembly 100 thereof might experience or undergo overtravel or overshoot movements, which would only be on the order of 0.005–0.010 inches, the cutting edge 222 of the cutter implement 220 would therefore not only completely sever or cut through the upper one 12 of the two overlapped ends 12 and 14 of the tensioned steel strap supported upon the anvil 102 and as illustrated in FIGS. 4 and 5 but would also begin to penetrate or score the upper surface region of the lower one 14 of the two overlapped ends 12 and 14 of the tensioned steel strap. However, unlike the instance described hereinbefore in connection with the severance or cutting of the upper one 12 of the two overlapped ends 12 and 14 of the tensioned steel strap wherein 80–90% of the upper one 12 of the two overlapped ends 12 and 14 of the tensioned steel strap was actually cut or severed and the remaining 10–20% of the upper end 12 of the brittle tensioned steel strap fractured or ruptured in view of the tensile stresses impressed thereon, in this instance, since there is no severing or cutting of the lower one 14 of the two overlapped ends 12 and 14 of the tensioned steel strap but only partial cutting, severing, or scoring of the upper surface region of the lower one 14 of the two overlapped ends 12 and 14 of the tensioned steel strap within only 80–90% of the lower one 14 of the two overlapped ends 12 and 14 of the tensioned steel strap as considered across its widthwise extent while no cutting, severing, or scoring whatever occurs within that 10–20% of the upper surface region of the lower end 14 of the tensioned steel strap which corresponds to the disposition or presence of the recessed portion or notched region 224 of the cutting edge 222 of the cutter implement 220, sufficient structural integrity remains within the lower one 14 of the two overlapped ends 12 and 14 of the tensioned steel strap such that the lower one 14 of the two overlapped ends 12 and 14 of the tensioned steel strap will not experience rupture or failure even when the strapping tool 10, and more particularly the cutting assembly 100 thereof, experiences overtravel or overshoot movements.

Thus it may be seen and appreciated that by means of the provision of the new and improved cutter implement of the present invention, and in accordance with the operative teachings thereof, the aforenoted potentially dangerous or hazardous conditions, which may have heretofore existed when the aforenoted type of cutting tools, and the cutting assemblies thereof, experienced overtravel or overshoot movements, will be effectively eliminated, and the particular package being strapped by means of the tensioned steel strapping will in fact remain securely fastened, strapped, and packaged.

Obviously, many modifications and variations of the present invention will be possible in light of the above teachings. It is therefore to be understood that within the scope of the appended claims, the present invention may be practiced otherwise than as specifically described herein.

I claim:

1. A cutter implement for compressively cutting a workpiece having a predetermined widthwise dimension, comprising:

a body portion having a cross-sectional configuration which is that of a regular polygon comprising a plurality of substantially identical, parallel, longitudinally extending parallel cutting edges whereby the workpiece can be cut across its widthwise extent by said cutter implement when a particular one of said substantially identical cutting edges of said cutter implement is disposed transversely across and compressively engaged with the workpiece; and non-cutting recessed means defined within each one of said substantially identical cutting edges of said cutter implement for permitting a predetermined portion of the workpiece, extending along the widthwise direction thereof, to remain intact despite engagement of other portions of the workpiece, along the widthwise extent, by said particular one of said cutting edges of said cutter implement.

2. A cutter implement as set forth in claim 1, wherein:

said non-cutting recessed means is disposed at a substantially central portion of each one of said cutting edges of said cutter implement as considered along the longitudinal extent thereof.

3. A cutter implement as set forth in claim 1, wherein:

said plurality of parallel cutting edges comprises three parallel cutting edges wherein each one of said three parallel cutting edges has said non-cutting recessed means defined therein.

4. A cutter implement as set forth in claim 3, wherein:

said regular polygon comprises an equilateral triangle.

5. In combination, a pair of vertically overlapped workpieces, and a cutter implement for undergoing vertical movements with respect to said pair of vertically overlapped workpieces and for compressively cutting an upper one of said pair of vertically overlapped workpieces while leaving a predetermined portion of a lower one of said pair of vertically overlapped workpieces structurally intact, comprising:

said pair of vertically overlapped workpieces having predetermined widthwise dimensions and upper surfaces disposed within substantially parallel planes; and said cutter implement compressively cutting said upper one of said pair of vertically overlapped workpieces while leaving said predetermined portion, as considered in the widthwise direction, of said lower one of said pair of vertically overlapped workpieces structurally intact when said cutter implement experiences vertically downward overtravel with respect to said pair of vertically overlapped workpieces, such that said cutter implement engages said upper surface of said lower one of said pair of vertically overlapped workpieces;

said cutter implement comprising a body portion having a cross-sectional configuration which is that of a regular polygon comprising a plurality of substantially identical, parallel, longitudinally extending cutting edges which are disposed substantially parallel to said upper surfaces of said pair of vertically overlapped workpieces, wherein the longitudinal extent of said cutting edge is at least equal to the widthwise dimension of said upper one of said pair of vertically overlapped workpieces such that said upper one of said pair of vertically overlapped workpieces is cut across its widthwise extent by a particular one of said substantially identical cutting edges of said cutter implement that is disposed transversely across and compressively engaged with said upper one of said pair of vertically overlapped workpieces; and non-cutting recessed means defined within each one of said substantially identical cutting edges of said cutter implement for permitting a predetermined portion of said lower one of said pair of vertically overlapped workpieces, extending along the widthwise extent therof, to remain intact despite engagement and scoring of other portions of said lower one of said pair of vertically overlapped workpieces, extending along said widthwise extent thereof, by said particular one of said cutting edges of said cutter implement should said cutter implement experience vertically downward overtravel with respect to said pair vertically overlapped workpieces.

6. The combination as set forth in claim 5, wherein:

said non-cutting recessed means is disposed at a substantially central portion of each one of said cutting edges of said cutter implement as considered along said longitudinal extent thereof.

7. The combination as set forth in claim 5, wherein:

said non-cutting recessed means has a depth dimension which is substantially equal to the thickness dimension of each one of said pair of vertically overlapped workpieces.

8. The combination as set forth in claim 5, wherein:

said non-cutting recessed means defined within each one of said cutting edges of said cutter implement has a width dimension which is within a range of 10–20% of said widthwise extent of said workpieces so that said predetermined portion of said lower one of said pair of vertically overlapped workpieces which remains intact has a width dimension which is approximately 10–20% of said widthwise extent of said workpieces.

9. The combination as set forth in claim 5, wherein:

said plurality of parallel cutting edges comprises three parallel cutting edges wherein each one of said three parallel cutting edges has said non-cutting recessed means defined therein.

10. The combination as set forth in claim 9, wherein:

said regular polygon comprises an equilateral triangle.

11. The combination as set forth in claim 5, wherein:

said pair of vertically overlapped workpieces comprise tensioned steel packaging straps.

12. In combination, a pair of vertically overlapped workpieces, and a cutting tool for undergoing vertical movements with respect to said pair of vertically overlapped workpieces and for compressively cutting an upper one of said pair of vertically overlapped workpieces while leaving a predetermined portion of a lower one of said pair of vertically overlapped workpieces structurally intact, comprising:

said pair of vertically overlapped workpieces having predetermined widthwise dimensions and upper surfaces disposed within substantially parallel planes; the cutting tool compromising an anvil supporting said pair of vertically overlapped workpieces thereon a cutter implement and, cutter holder means for holding said cutter implement during vertical movement toward and away from said anvil and said pair of vertically overlapped workpieces supported on said anvil;

said cutter implement compressively cutting said upper one of said pair of vertically overlapped workpieces while leaving said predetermined portion, as considered in the widthwise direction, of said lower one of said pair of vertically overlapped workpieces structurally intact when said cutter holder means, and said cutter implement mounted therein, experiences vertically downward overtravel with respect to said pair of overlapped workpieces, such that said vertically cutter implement engages said upper surface of said lower one of said pair of vertically overlapped workpieces;

said cutter implement comprising a body portion having a cross-sectional configuration which is that of a regular polygon comprising a plurality of substantially identical, parallel, longitudinally extending cutting edges which are disposed substantially parallel to said upper surfaces of said pair of vertically overlapped workpieces, wherein the longitudinal extent of said cutting edge is at least equal to the widthwise dimension of said upper one of said pair of vertically overlapped workpieces such that said upper one of said pair of vertically overlapped workpieces is cut across its widthwise extent by a particular one of said substantially identical cutting edges of said cutter implement that is disposed transversely across and compressively engaged with said upper one of said pair of vertically overlapped workpieces; and non-cutting recessed means defined within each one of said substantially identical cutting edges of said cutter implement for permitting a predetermined portion of said lower one of said pair of vertically overlapped workpieces, extending along the widthwise extent therof, to remain intact despite engagement and scoring of other portions of said lower one of said pair of vertically overlapped workpieces, extending along said widthwise extent thereof, by said particular one of said cutting edges of said cutter implement should said cutter implement experience vertically downward overtravel with respect to said pair of vertically overlapped workpieces.

13. The combination as set forth in claim 12, wherein:

said non-cutting recessed means is disposed at a substantially central portion of each one of said cutting edges of said cutter implement as considered along said longitudinal extent thereof.

14. A cutting tool as set forth in claim 12, wherein:

said non-cutting recessed means has a depth dimension which is substantially equal to the thickness dimension of each one of said pair of vertically overlapped workpieces.

15. A cutting tool as set forth in claim 12, wherein:

said non-cutting recessed means defined within each one of said cutting edges of said cutter implement has a width dimension which is within a range of 10–20% of said widthwise extent of said workpieces so that said predetermined portion of said lower one of said pair of vertically overlapped workpieces which remains intact has a width dimension which is approximately 10–20% of said widthwise extent of said workpieces.

16. A cutting tool as set forth in claim 12, wherein:

said plurality of parallel cutting edges comprises three parallel cutting edges wherein each one of said three parallel cutting edges has said non-cutting recessed means defined therein.

17. A cutting tool as set forth in claim 16, wherein:

said regular polygon comprises an equilateral triangle.

18. A cutting tool as set forth in claim 12, wherein:

said pair of vertically overlapped workpieces comprise tensioned steel packaging straps.

19. A cutter implement for compressively cutting a workpiece having a predetermined widthwise dimension, comprising:

a solid body portion having a cross-sectional configuration which is that of a regular polygon comprising a plurality of substantially identical, parallel longitudinally extending cutting edges whereby the workpiece can be cut across its widthwise extent by said cutter implement when a particular one of said substantially identical cutting edges of said cutter implement is disposed transversely across and compressively engaged with the workpiece; and a single non-cutting recessed means defined within each one of said substantially identical cutting edges of said cutter implement for permitting a predetermined portion of the workpiece, extending along the widthwise direction thereof, to remain intact despite engagement of other portions of the workpiece, along the widthwise extent, by said particular one of said cutting edges of said cutter implement.

20. A cutter implement as set forth in claim 19, wherein:

said non-cutting recessed means is disposed at a substantially central portion of each one of said cutting edges of said cutter implement as considered along the longitudinal extent thereof.

21. A cutter implement as set forth in claim 19, wherein:

said plurality of parallel cutting edges comprises three parallel cutting edges wherein each one of said three parallel cutting edges has said non-cutting recessed means defined therein.

22. A cutter implement as set forth in claim 21, wherein:

said regular polygon comprises an equilateral triangle.

* * * * *